US006260267B1

(12) United States Patent
Ohta

(10) Patent No.: US 6,260,267 B1
(45) Date of Patent: Jul. 17, 2001

(54) MANUFACTURE OF A WIRE HARNESS

(75) Inventor: Yoshinobu Ohta, Nagoya (JP)

(73) Assignees: Harness System Technologies; Sumitomo Wiring Systems, Ltd.; Sumitomo Electric Industries, Ltd., all of Mie (JP)

( * ) Notice: Subject to any disclaimer, the term of this patent is extended or adjusted under 35 U.S.C. 154(b) by 0 days.

(21) Appl. No.: 09/426,587

(22) Filed: Oct. 25, 1999

Related U.S. Application Data

(62) Division of application No. 08/934,856, filed on Sep. 22, 1997.

(30) Foreign Application Priority Data

Sep. 27, 1996 (JP) ..... 8-256135

(51) Int. Cl.[7] ..... H01R 43/04

(52) U.S. Cl. ..... 29/863; 29/747; 29/748; 29/749

(58) Field of Search ..... 29/861, 863, 747, 29/748, 749, 753, 755, 866, 857, 566.1, 566.3

(56) References Cited

U.S. PATENT DOCUMENTS

| | | | | |
|---|---|---|---|---|
| 3,946,471 | | 3/1976 | Link . | |
| 4,403,407 | * | 9/1983 | Mazzola | 29/749 |
| 4,428,114 | | 1/1984 | Teagno . | |
| 4,495,682 | | 1/1985 | Matsui et al. . | |
| 4,499,648 | | 2/1985 | Brown et al. . | |
| 4,616,396 | * | 10/1986 | Matsui | 29/566.1 |
| 4,703,543 | * | 11/1987 | Aceti et al. | 29/749 |
| 4,815,913 | | 3/1989 | Hata et al. . | |
| 4,888,864 | | 12/1989 | Masaki . | |
| 4,970,778 | | 11/1990 | den Otter . | |
| 4,982,830 | * | 1/1991 | Strong et al. | 29/749 |
| 5,063,656 | | 11/1991 | Hirano et al. . | |
| 5,365,659 | * | 11/1994 | Ueda et al. | 29/863 |
| 5,404,634 | | 4/1995 | Takeshita et al. . | |
| 5,471,741 | * | 12/1995 | Heisner et al. | 29/857 |
| 5,903,970 | * | 5/1999 | Pittau | 29/748 |

FOREIGN PATENT DOCUMENTS

| | | |
|---|---|---|
| 2 721 445 | 12/1995 | (FR) . |
| WO 86/06220 | 10/1986 | (WO) . |

* cited by examiner

*Primary Examiner*—Lee Young
*Assistant Examiner*—Sean Smith
(74) *Attorney, Agent, or Firm*—Oliff & Berridge, PLC.

(57) ABSTRACT

Both ends of a plurality of parallel electrical wires are respectively connected to the connectors with pressure by a pressure-connecting and wiring machine into which the plurality of electrical wires are introduced, and the thus introduced electrical wires are sent to the electrical wire pressure-connecting section via the electrical wire cutting section. At this time, the connectors are successively fed to the electrical wire pressure-connecting section of the pressure-connecting and wiring machine in the direction parallel with the arrangement of the pressure terminals. After the electrical wires have been connected to the connector with pressure, the pressure-connected electrical wires of a predetermined length are drawn out from the pressure-connecting and wiring machine. Then the pressure-connecting and wiring machine is turned round the vertical axis by an angle of 180°, and the electrical wires, which have been drawn out before, are connected to the other connector with pressure and cut. At this time, the positions to which the electrical wires are drawn out are located in the front and at the rear with respect to the parallel direction of the connectors. Therefore, it is easy to ensure the space in which the electrical wires are accumulated.

8 Claims, 19 Drawing Sheets

MANUFACTURE OF A WIRE HARNESS

This is a Division of application Ser. No. 08/934,856 filed Sep. 22, 1997. The entire disclosure of the prior application is hereby incorporated by reference herein in its entirety.

BACKGROUND OF THE INVENTION

1. Field of the Invention

The present invention relates to a method of manufacturing a wire harness in which both ends of a plurality of parallel electrical wires are respectively connected to connectors with pressure. Also, the present invention relates to a pressure-connecting and wiring machine by which the above manufacturing method can be carried out.

2. Description of the Related Art

Electrical units incorporated into an automobile are electrically connected to each other by a wire harness. For example, as shown in FIG. 19, this wire harness is composed in such a manner that two connectors C are connected to each other by electrical wires F. In FIG. 19, there is shown a subassembly W, the electrical wires of which are temporarily bundled up, and this subassembly W is referred to as a wire harness W in a broad sense. When the electrical wires of this subassembly are bundled up into a final predetermined shape, the wire harness W can be manufactured.

In general, in the wire harness W, the electrical wire F is connected to the connector C in such a manner that a terminal is crimped to an end of the electrical wire and then inserted into a cavity formed in the connector C. However, when the above crimping-connection is conducted, it is necessary to provide a large number of manufacturing processes.

Therefore, when the wire harness is manufactured recently, as shown in FIG. 20, the method of pressure-connection, the number of manufacturing processes of which is small, is adopted to connect the electrical wire F to the connector C.

In general, this connection with pressure (referred to as pressure-connection hereinafter) is conducted by a pressure-connecting and wiring machine into which a plurality of electrical wires are introduced and these electrical wires F are introduced into an electrical wire pressure-connecting section via an electrical wire cutting section, so that the electrical wires can be connected to a connector with pressure.

In the pressure-connecting and wiring machine, the electrical wire F, the outer diameter of which is a little larger than the groove width of the pressure-terminal of the connector C, is pushed into the groove (U-slot) of the pressure-terminal of the connector C, and the electrical wire is fixed in the groove by the action of spring-back of the pressure-terminal. At this time, not only the electrical wire F is fixed, but also the cover of the electrical wire is torn by the inner wall of the groove when the electrical wire F is pushed into the groove, so that the conductor of the electrical wire is contacted with the inner wall of the terminal for electrical communication (shown in FIGS. 13 and 14 in the embodiment).

As shown in FIG. 20, in the above pressure-connection, there are provided connectors C at both ends of the electrical wires F, and pressure-terminal sections of both connectors C are opposed to each other. Since a direction of the electrical wire to be drawn out to the electrical wire pressure-connecting section of the pressure-connecting and wiring machine is constant, when the connectors C are located in such a manner that the pressure-terminals of both connectors are opposed to each other as shown in FIG. 20, that is, when directions of both connectors are different from each other, it is possible to conduct a pressure-connecting and wiring motion by moving the pressure-connecting and wiring machine linearly from one connector C to the other connector C.

However, in order to arrange the connectors C in the different directions as described above, the connector arranging work becomes complicated, and it becomes difficult to adopt a robot to conduct this connecting work. Further, when the electrical wires F provided between both connectors C, C are handled, problems may be caused, because the connectors C are conveyed in the central axial direction in many cases, that is, the connectors C are conveyed in the transverse direction in FIG. 20, and it is difficult to ensure a space for accumulating the electrical wires F between the connectors C.

SUMMARY OF THE INVENTION

It is a task of the invention to ensure a space for accumulating the electrical wires between the connectors.

In order to solve the above problems, the present invention described in claim 1 is to provide a method of manufacturing a wire harness in which both ends of a plurality of electric wires are respectively connected to connectors with pressure by a pressure-connecting and wiring machine including the steps of: feeding the connectors one after another to an electric wire pressure-connecting section of the pressure-connecting and wiring machine in a parallel direction of the arrangement of pressure-terminals; first connecting one ends of the electric wires to the pressure-terminals of the one connector with pressure; drawing out the pressure-connected electric wires from the pressure-connecting and wiring machine by a predetermined length; turning the pressure-connecting and wiring machine round the axis of the vertical direction in a range of a predetermined angle; and second connecting the other ends of the electric wires drawn out before to the pressure-terminals of the other connector with pressure.

Due to the foregoing, it becomes possible to ensure spaces for accumulating the electrical wires, which are laid between the connectors, on both sides of the connectors in the parallel direction. On both sides of the connectors in the parallel direction, it is easy to ensure the accumulating spaces (shown in FIG. 1 of the embodiment). Further, since the pressure-connecting and wiring machines is turned by an angle of 180° so as to conduct pressure-connection on the connector, no electrical wires are twisted, and it is possible to obtain a wire harness, the pressure-connecting sections of the connectors at both ends of which are opposed to each other.

DETAILED DESCRIPTION OF THE PREFERRED EMBODIMENTS

Figure 1:
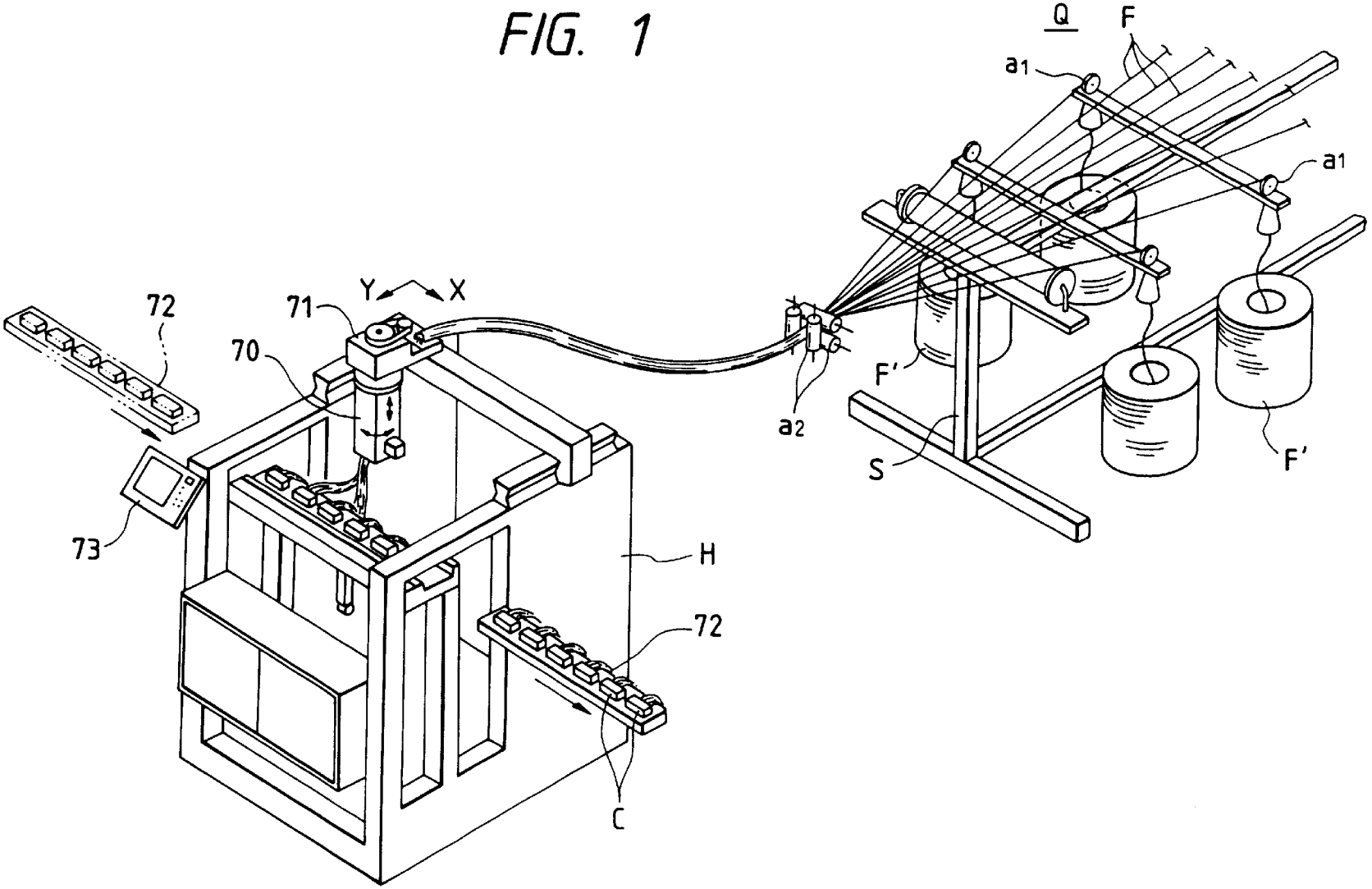
FIG. 1 is a perspective view showing an outline of an embodiment of the manufacturing apparatus of the present invention.
Figure 2:
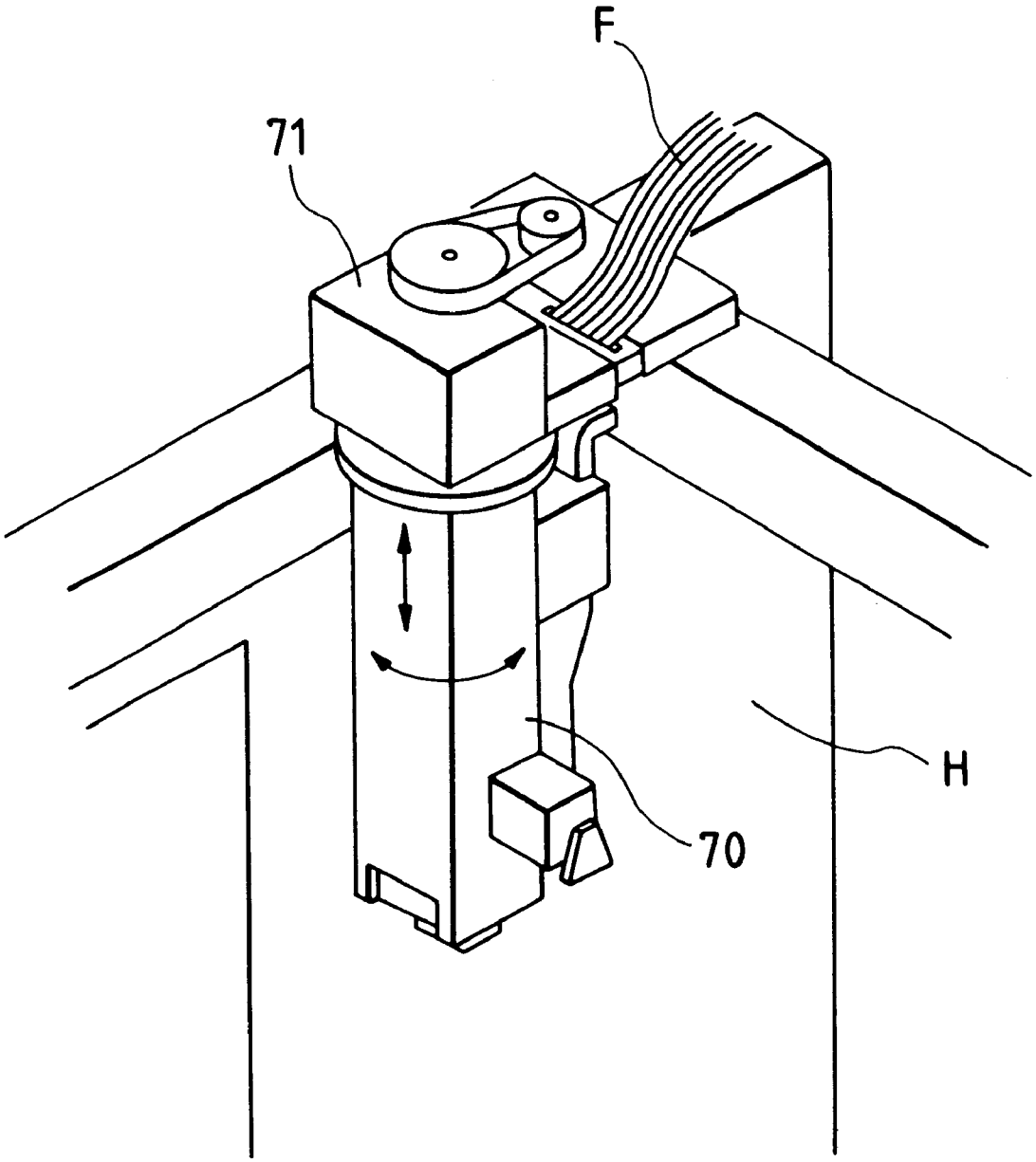
FIG. 2 is an enlarged view showing a primary portion of the apparatus.

FIGS. 1 and 2 are views showing an embodiment of the apparatus for manufacturing a wire harness W for automobile use. FIGS. 3 to 7 are views showing an embodiment of the pressure-connecting and wiring apparatus. In these views, reference character Q is an electric wire feed machine, reference character 70 is a pressure-connecting and wiring machine, and reference character W is a wire harness.

The electrical wire feed machine Q includes a supply stand S in which a plurality of electrical wire bundles F' are provided in such a manner that the electrical wire bundles F' can be arbitrarily replaced. From each electrical wire bundle F', the electrical wires F are drawn out and guided to the pressure-connecting and wiring machine 70 via the guide sheave $a_1$ and the guide roller $a_2$. The number of electrical wires F to be drawn out is arbitrarily determined, and the electrical wires F are drawn out by the pressure-connecting and wiring machine 70.

The pressure-connecting and wiring machine 70 is attached to the machine frame H in such a manner that it can be freely moved in the directions of the axes of X and Y. Also, as shown by the arrows in FIG. 2, the pressure-connecting and wiring machine 70 can be rotated round the central axis and moved upward and downward. When the pressure-connecting and wiring machine 70 is moved in the directions of the axes of X and Y, -also when the pressure-connecting and wiring machine 70 is rotated round the central axis, and also when the pressure-connecting and wiring machine 70 is moved upward and downward, a drive mechanism incorporated into the block 71 to support the pressure-connecting and wiring machine 70 is operated according to the direction given by the operation panel 73. A predetermined number of connectors C are put on the pallets 72 and conveyed to the pressure-connecting position. After the completion of pressure-connection, the connectors C are sent out. This operation to convey the connectors C is conducted manually or automatically by a robot.

Figure 13:
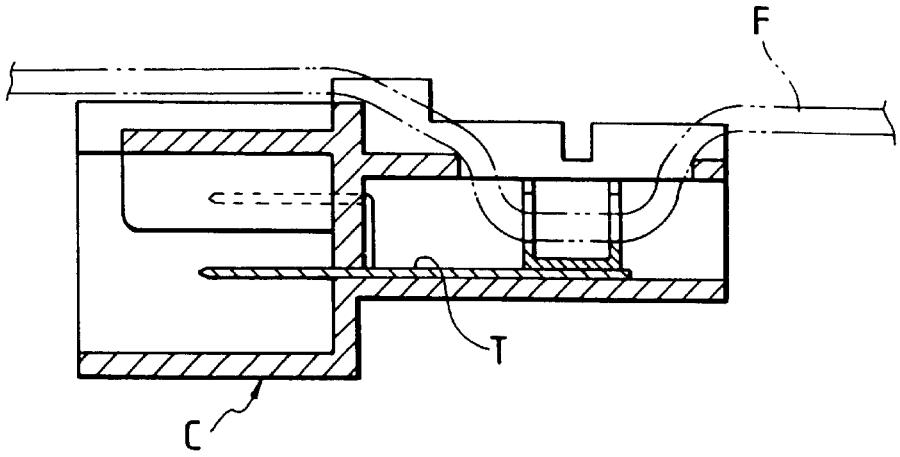
FIG. 13 is a cross-sectional front view of the primary portion of FIG. 12.
Figure 14:
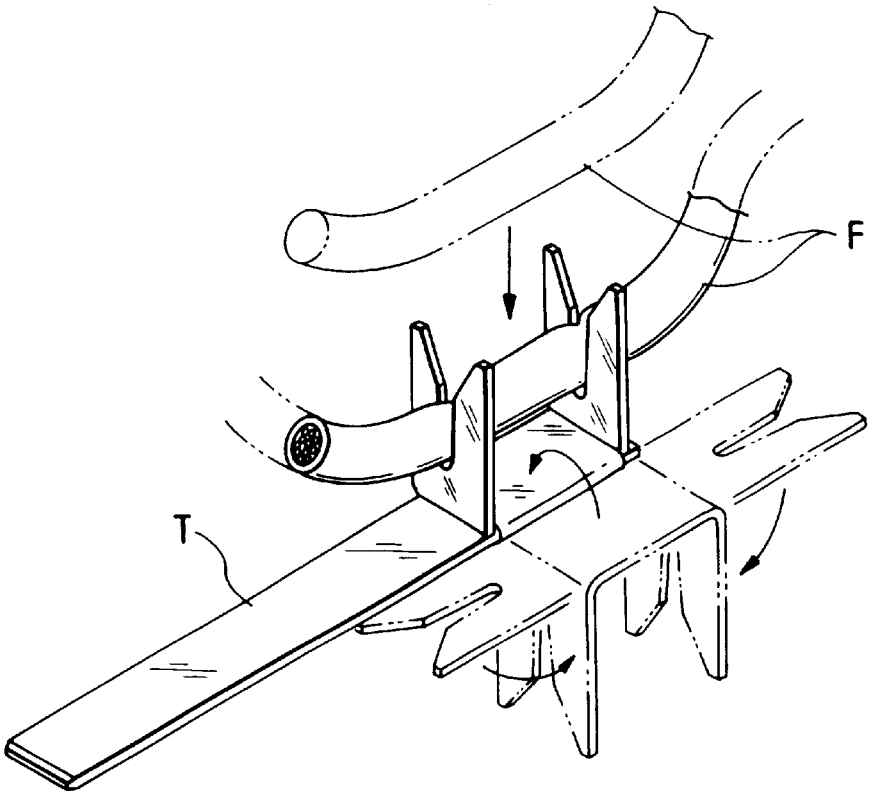
FIG. 14 is a perspective view of the primary portion of FIG. 12.

The cross-sectional shape of the connector C is shown in FIG. 13. The shape of the terminal T is shown in FIG. 14. The terminal T is formed by bending a piece of material so that it can be raised from the shape shown by chain lines to the shape shown by solid lines. The thus formed terminal T is inserted into the connector housing C. The electrical wire F is press-fitted into the slot of the terminal T.

This pressure-connecting and wiring machine 70 includes: a pressure-connecting section 1 having a set A of a plurality of pressure-blades 2 . . . which can be operated individually and also having a set B of a plurality of pressure-blades 52, . . . ; and an electrical wire feed section 40 to feed the electrical wires F to positions close to the pressure-blades 2, 52. A selecting mechanism 50 to select the pressure-blade is incorporated into the above pressure-connecting section 1. The selecting mechanism 50 selects desired pressure-blades 2, 52 from the sets A, B of the pressure-blades 2, 52, and only the selected pressure-blades 2, 52 can be operated.

Figure 3:
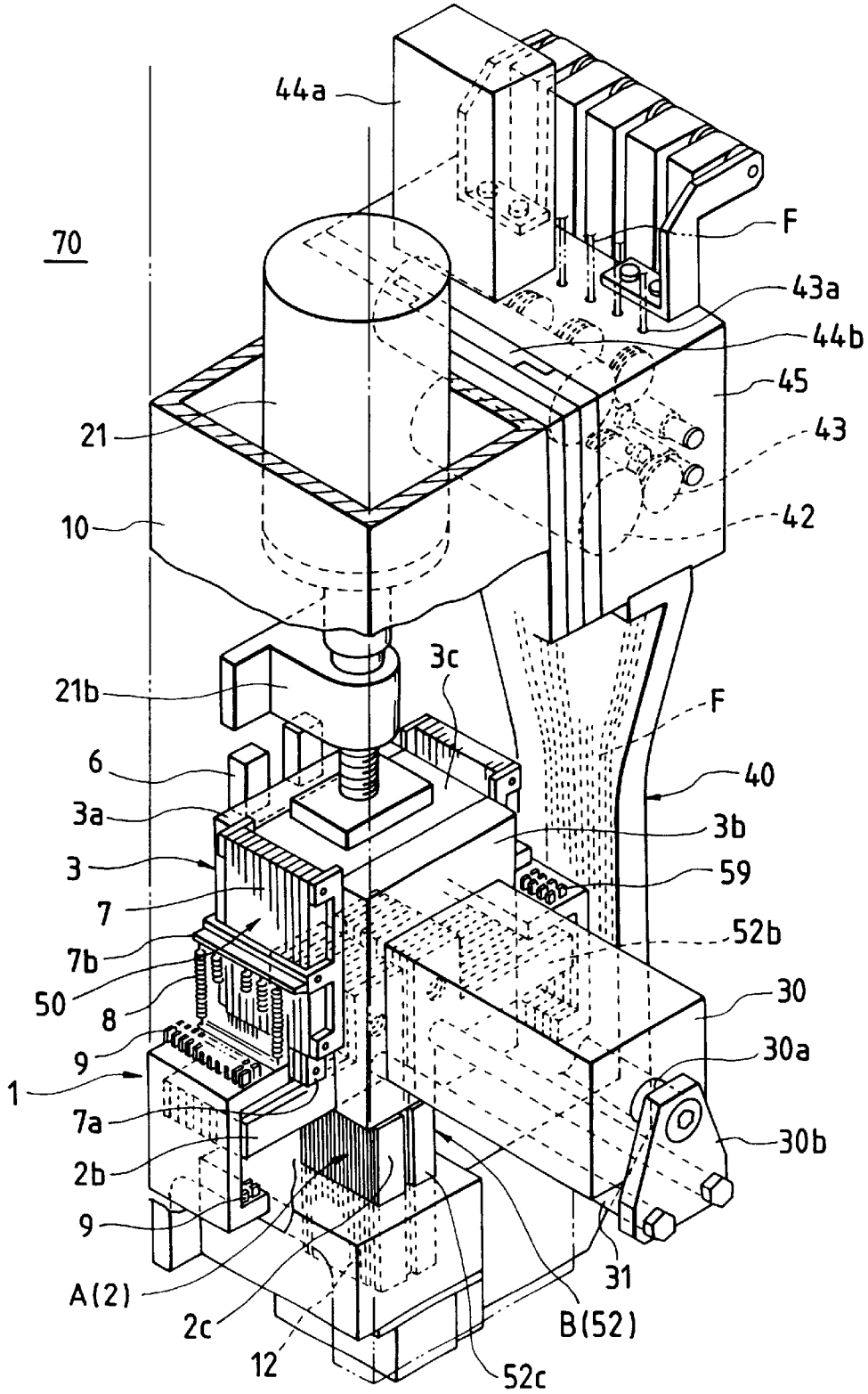
FIG. 3 is a perspective view of an embodiment of the pressure-connecting and wiring machine.

As shown in FIG. 3, the pressure-connecting section 1 includes the sets A, B of the plurality of pressure-blades 2, 52. In the pressure-connecting section 1, there is provided an elevating block 3 which elevates with respect to the pressure-terminals of the connector. This elevating block 3 is formed into a C-shaped rectangular frame by the two opposed side plates 3*a*, 3*b* and the upper plate 3*c*. Between the two opposed side plates 3*a*, 3*b*, the sets A, B of the plurality of pressure-blades 2, 52 are arranged which will be described later.

Figure 4:
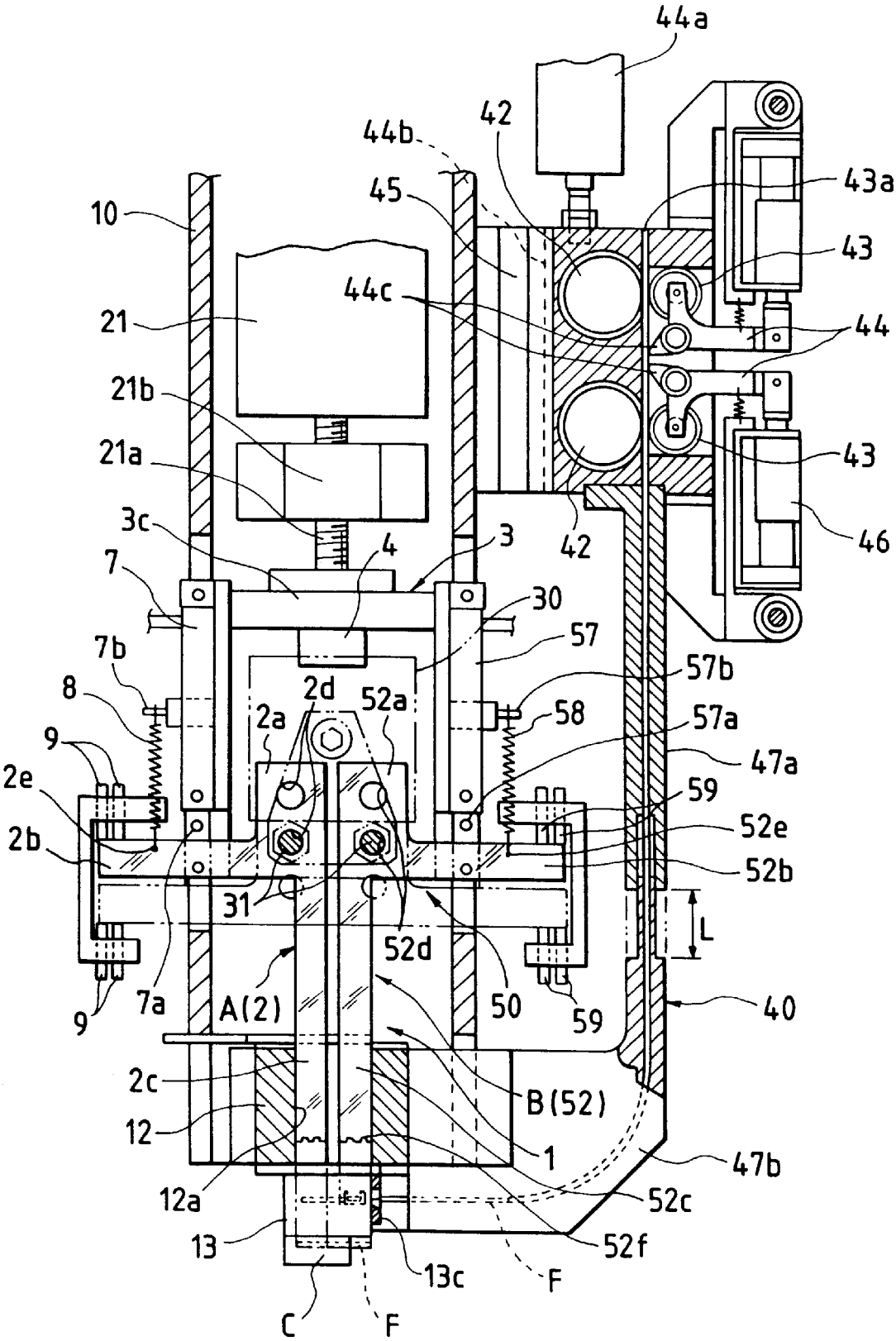
FIG. 4 is a cross-sectional front view of the primary portion of the pressure-connecting and wiring machine.
Figure 5:
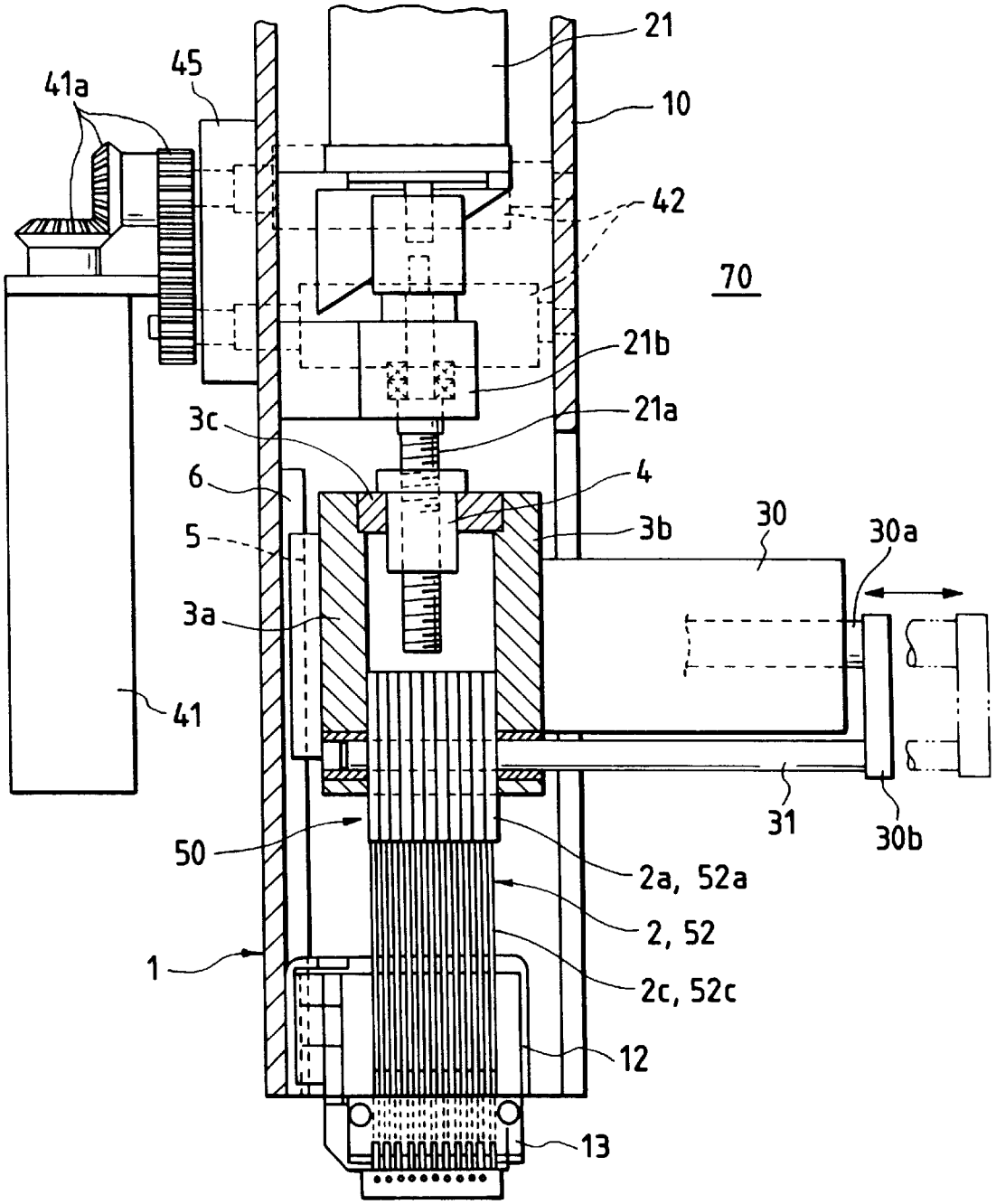
FIG. 5 is a cross-sectional side view of the primary portion of the pressure-connecting and wiring machine.

As illustrated in FIGS. 4 and 5, on the upper plate 3c of the elevating block 3, there is provided a ball nut 4. Into this ball nut 4, a rotational shaft 21*a* of the servo motor 21 attached to the upper portion of the frame 10 is screwed via the bearing 21*b*. Therefore, when the rotational shaft 21*a* is rotated, the elevating block 3 can be elevated. On the outer surface of one side plate 3*a* of the elevating block 3, there are provided two guide grooves 5, 5 which are arranged in the vertical direction. In the frame 10, there are provided two guide rails 6, 6 which engage with these grooves 5, 5. The elevating block 3 is elevated along these guide rails 6, 6.

Figure 6:
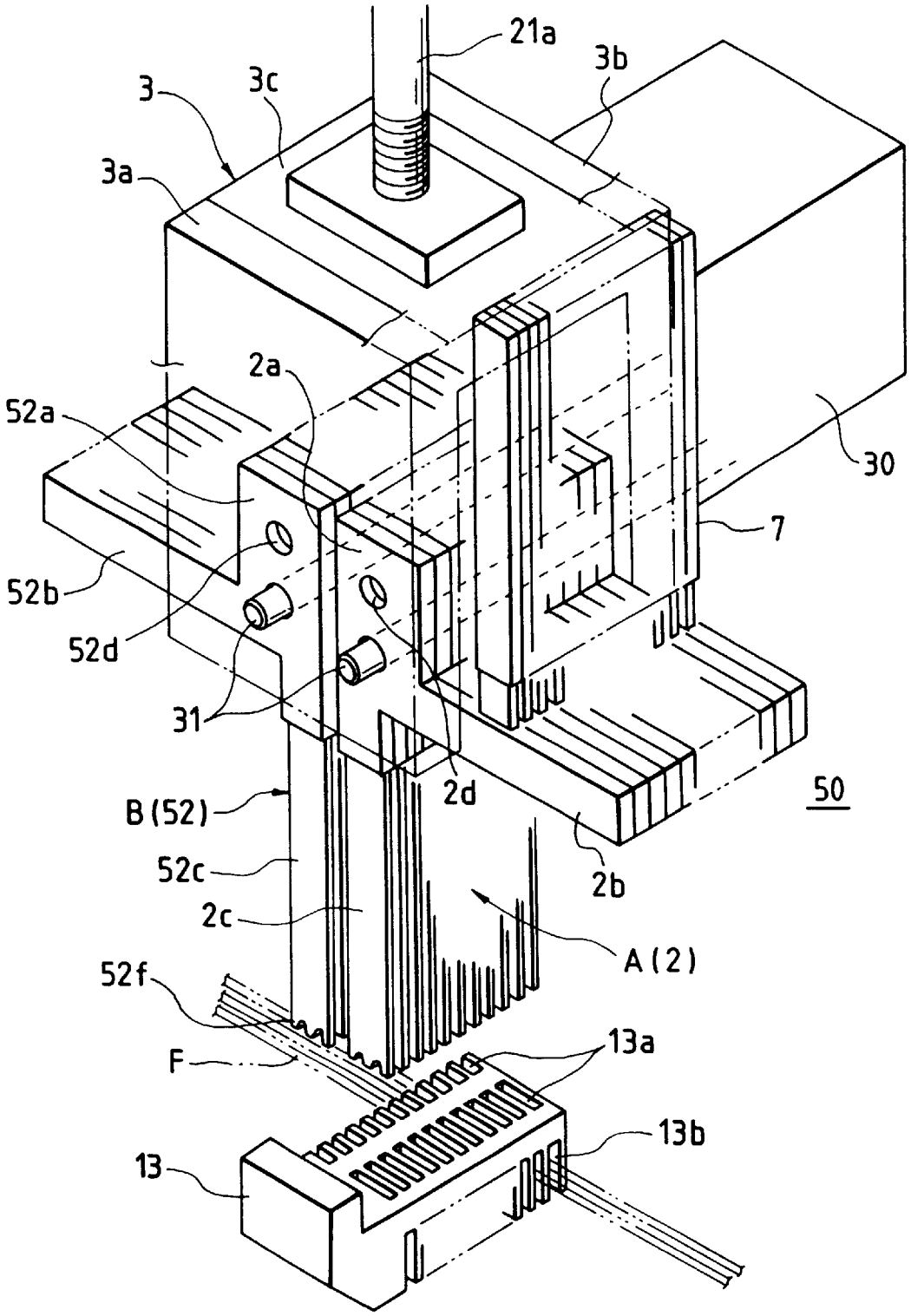
FIG. 6 is a perspective view showing a selecting mechanism of the pressure-blade of the pressure-connecting and wiring machine.
Figure 7:
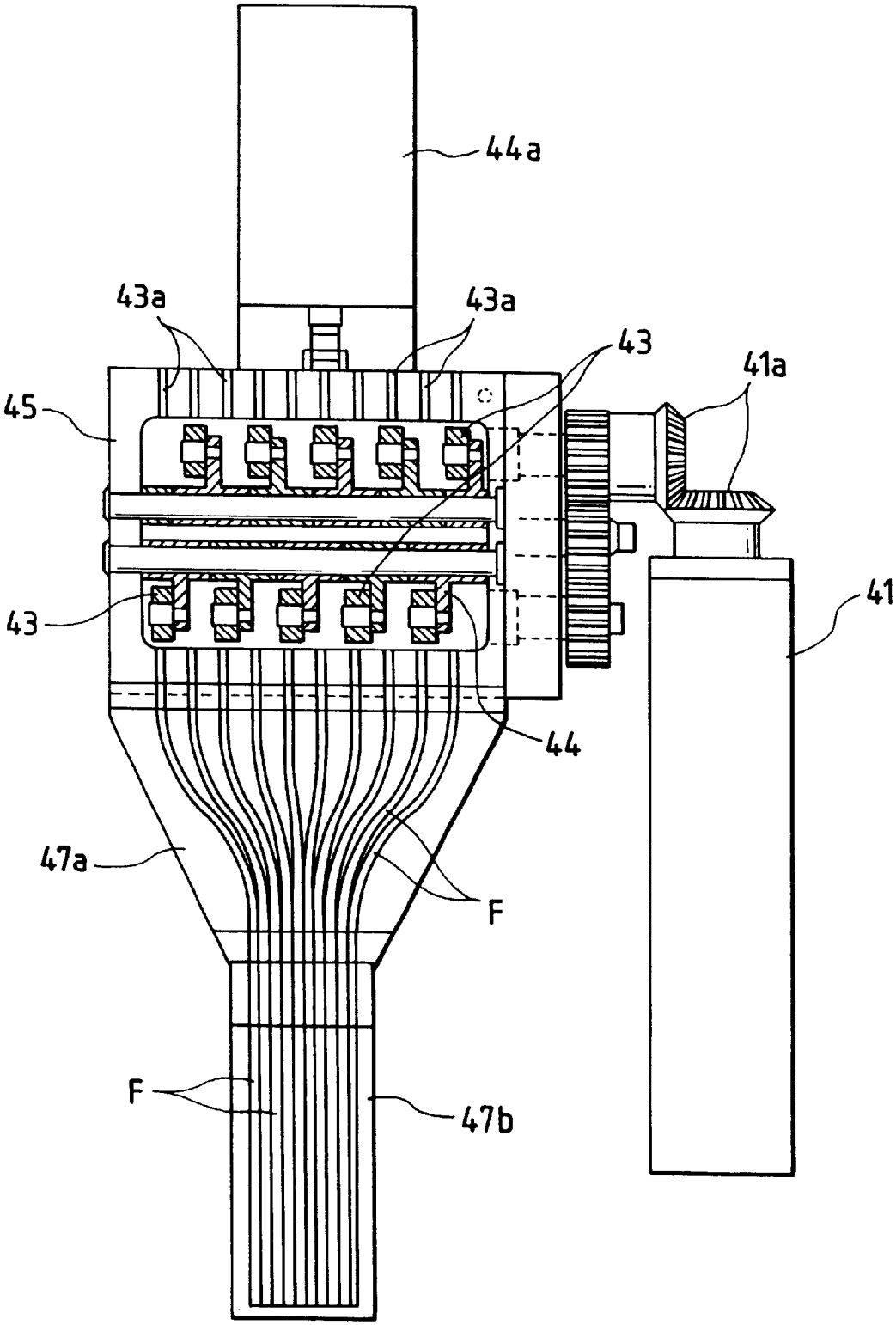
FIG. 7 is a rear view showing a primary portion of the electrical wire feed section of the pressure-connecting and wiring machine.

Next, the arrangement and action of the pressure-blades 2, 52 and the selecting mechanism 50 will be explained below. As shown in FIGS. 4 and 6, the pressure-blades 2, 52 are composed of plate-shaped bodies having L-shaped sections 2*a*, 52*a* and also composed of belt-shaped blade bodies 2*c*, 52*c* soldered to the L-shaped sections 2*a*, 52*a*. The thus formed pressure-blades 2, 52 are arranged between the side plates 3*a* and 3*b* of the elevating block 3 in such a manner that the surfaces of the pressure-blades 2, 52 are set in parallel with the surfaces of both side plates 3*a*, 3*b*, and the numbers of the pressure-blades 2, 52 are the same as those of the pressure-terminals of the connectors.

The L-shaped sections 2*a*, 52*a* of the pressure-blades 2, 52 are arranged along the surfaces of the side plates 3*a*, 3*b* symmetrically with respect to the transverse direction. In the vertical sections of the L-shaped section 2*a*, 52*a*, there are provided two insertion holes 2*d*, 52*d* for each vertical section, and the following selecting bars are inserted into these insertion holes 2*d*, 52*d*.

As illustrated in FIGS. 4 and 6, on the upper edge sides of the L-shaped horizontal sections 2*b*, 52*b* of the pressure-blades 2, 52, there are provided air cylinders 7, 57, and these air cylinders correspond to the pressure-blades by one-to-one. Reference numeral 57 is omitted in FIG. 6. In the middle sections of the air cylinders 7, 57, there are provided engaging protrusions 7*b*, 57*b*. Between these engaging protrusions 7*b*, 57*b* and the engaging holes 2*e*, 52*e* provided in the L-shaped horizontal sections 2*b*, 52*b*, there are provided springs 8, 58, so that the pressure-blades 2, 52 are pushed upward at all times. The L-shaped horizontal sections 2*b*, 52*b* are pushed downward by the rods 7*a*, 57*a* of the cylinders 7, 57 against the spring forces, so that the pressure-blades 2, 52 can be positioned at specific vertical positions.

On the outer surface of the side plate 3*b* of the elevating block 3, as illustrated in FIGS. 5 and 6, there is provided an air cylinder 30 which is attached perpendicular to the side plate 3*b*. At the end of the rod 30*a* of the air cylinder 30, there are provided two selecting bars 31, 31, and also there are provided a plate-shaped selecting bar holder 30*b* attached perpendicular to the plate surface.

The selecting bars 31 function as follows. The L-shaped horizontal sections 2*b*, 52*b* of the desired pressure-blades 2, 52 in the sets A and B of the pressure-blades 2, 52 are pushed downward by the rods 7*a*, 57*a* of the cylinders 7, 57. After that, the selecting bars 31 fixes the pushed L-shaped horizontal sections 2*b*, 52*b*. The thus pushed L-shaped horizontal sections 2*b*, 52*b* are protruded from the lower ends of the residual pressure-blades 2, 52 and fixed in this state.

In order to make the desired pressure-blades 2, 52 protrude from the lower ends of the residual pressure-blades 2, 52 and fix them in the state, the pressure-blades 2, 52 are pushed downward by the cylinders 7, 57 until the centers of the upper side holes of the insertion holes 2*d*, 52*d* in the L-shaped vertical sections coincide with the axial centers of the selecting bars 31. In the above state, the above cylinders 30 are operated, and the selecting bars 31 are inserted into the upper side insertion holes 2*d*, 52*d* (shown in FIG. 4).

In this connection, as illustrated in FIG. 4, in order to make certain the vertical positions of the pressure-blades 2, 52, there are provided electromagnetic sensors 9, 59 to detect the elevation of the pressure-blades 2, 52, on the vertical lines which pass through the end portions of the L-shaped horizontal sections 2*b*, 52*b* protruding from the side of the elevating block 3.

As described above, the desired pressure-blades 2, 5 are protruded from the lower ends of other pressure-blades 2, 52 and fixed in the state. When the pressure-blades in the above state are lowered by the elevating blocks 3, 3, only the protruding pressure-blades 2, 52 are inserted into the grooves of the pressure-terminals. Accordingly, only the electrical wires F fed to the positions of the pressure-blades 2, 52 are connected to the connectors with pressure (shown in FIG. 4).

As illustrated in FIGS. 3 to 5, the lower end portions of the belt-shaped blade bodies 2*c*, 52*c* are gently inserted into the guide holes 12*a* of the guide blocks 12. Therefore, as described later, when the pressure-blades 2, 52 are elevated by the elevating block 3, the side formed by a bundle of the pressure-blades 2 of the set A and the side formed by a bundle of the pressure blades 52 of the set B slide along the inner surface of the guide holes 12*a*, so that the pressure blades 2, 52 can be smoothly elevated. This guide block 12 is fixed to the frame 10 by bolts.

Further, as illustrated in FIG. 6, in order to correctly guide the pressure-blades 2, 52 to the grooves of the pressure-terminals of the connector when the elevating block 3 is lowered, in the pressure-connecting section 1, there is provided another guide block 13 at a position where the belt-shaped sections 2*c*, 52*c* of the pressure-blades 2, 52 protrude downward from the aforementioned guide block 12. The lower end portions of the belt-shaped sections 2*c*, 52*c* are engaged in the slits 13*a* formed in the guide block 13 in the vertical direction.

This guide block 13 is fixed to the frame 10 by bolts. As illustrated in FIG. 6, in the guide block 13, in addition to the slits 13*a* formed in the vertical direction, there are formed slits 13*b* which penetrate the guide block 13 in the longitudinal direction. Into these slits 13*b* formed in the longitudinal direction, the electrical wires F are guided from the electric wire feed section 40. The pressure blades 2, 52 are inserted into the slits 13*a* formed in the vertical direction. The pressure blades 2, 52 push downward the electric wires F so that they can be connected with pressure. At this time, the slits 13*b* function as guides, so that the electric wires F can be guided to the connector. Accordingly, pressure-connection can be accomplished without causing the disconnection of the electric wires F from the pressure-blades 2, 52. In FIG. 6, the guide block 13 is clearly shown. Therefore, the guide block 12 arranged above the guide block 13 is not shown in the drawing.

A side end section of the belt-shaped section 52*c* of the pressure-blade 52 of the set B on the side of the electrical wire feed section 40 is a cutting blade 52*f* to cut the electrical wires F. The corresponding lower blade 13*c* is arranged in the guide block 13 (shown in FIGS. 4 and 6). The width of the lower blade 13*c* covers the entire length of the electrical wires F in the parallel direction. When the pressure-blade 52 is lowered, the electrical wires F are cut by the lower blade 13*c* in cooperation with the cutting blade 52*f*.

The shapes of the cutting blades 2, 52 and the arrangement and action of the selecting mechanism 50 are described above. In order for the selecting mechanism 50 to be operated properly, the following precondition is required. When the selecting bar 31 is inserted into the lower insertion hole, which is one of the two insertion holes 2*d*, 52*d* formed in the L-shaped vertical sections of the pressure-blades 2, 52, that is, when the pressure-blades 2, 52 are located at the upper dead points, it is important that the lower dead points are located at the position of the elevating block 3 so that the pressure-blades 2, 52 can not be inserted into the grooves of the pressure terminals of the connector C even if the elevating black 3 is lowered.

Next, referring to FIGS. 3 to 5 and FIG. 7, the electrical wire feed section 40 will be explained below. The electrical wire feed section 40 includes: a pair of rotational rollers 42 (shown in FIG. 5) rotated by the motor 41 via the gears 41*a*; and feed rollers 43 coming into contact with the rollers 42 as illustrated in FIG. 4. The pair of rotational rollers 42 are rotated by the gears 41*a* in the same rotational direction at the same speed (shown in FIG. 5). The motor 41 and the rollers 42, 43 are mounted on the moving block 45. This moving block 45 is moved upward and downward along the guide 44*b* by the air cylinder 44*a* fixed to the frame (apparatus body) 10.

The feed rollers 43 are arranged in the width direction (the transverse direction in FIG. 7) zigzag with respect to the vertical direction so that the adjacent rollers 43 can not interfere with each other. The electrical wires F are introduced from the guide hole 43*a* into between each feed roller 43 and rotational roller 42. When both rollers 42, 43 are rotated coming into pressure contact with each other via the electric wires F, the electric wires F can be fed downward.

As shown in FIG. 4, each feed roller 43 is attached to one end of the Y-shaped link 44, and the other end 44*c* of the Y-shaped link 44 is formed into a pressure piece. The base end of each link 44 is connected to the plunger of the air cylinder 46. When the plunger is advanced or retracted, it is possible to select one of the following two states. One is a state in which the feed roller 43 comes into contact with the rotational roller 42, and the other is a state in which the feed roller 43 is separated from the rotational roller 42, so that the pushing piece 44*c* can be contacted with the electrical wires F with pressure.

There is provided one electrical wire guide 47*a* on the lower surface of the moving block 45. After the electrical wires F have been fed by the rotational roller 42 and the feed roller 43, they pass through in this guide 47*a* and are introduced into the pressure-contacting section 1. There is provided the other electrical wire guide 47*b* at the lower portion on the front surface of the frame 10. Into this guide 47*b*, the guide 47*a* is introduced and guided into the pressure-connecting section 1. Connecting sections of both guides 47*a*, 47*b* are engaged with each other in such a manner that they can appear and disappear freely.

As shown in FIG. 4, the electrical wires F are pushed downward and connected to the pressure-terminal of the connector with pressure as follows. Under the condition that the electrical wires F are pushed by the pushing piece 44*c*, the air cylinder 44*a* of the electrical wire feed section 40 is extended, so that the block 45 can be lowered by the length L. In accordance with the length L, the electrical wires F protrude from the lower blade 13*c* and enter the slit 13*b* of the guide block 13. When the pressure-blade 2 is lowered under the above condition, the electrical wires F are pushed downward and connected to the pressure-terminal of the connector with pressure.

Figure 8A:
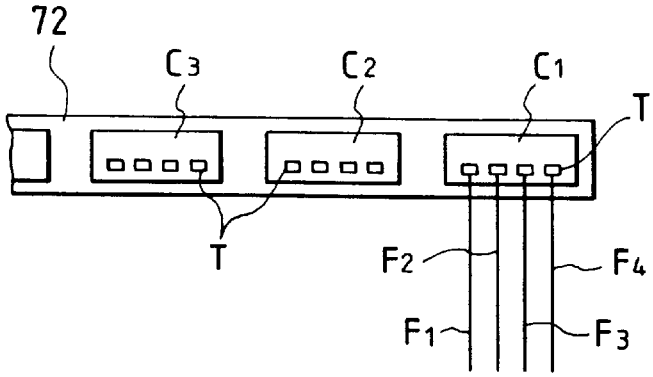
FIGS. 8A to 8E are schematic illustrations to explain the pressure-connection and wiring of the embodiment.
Figure 8B:
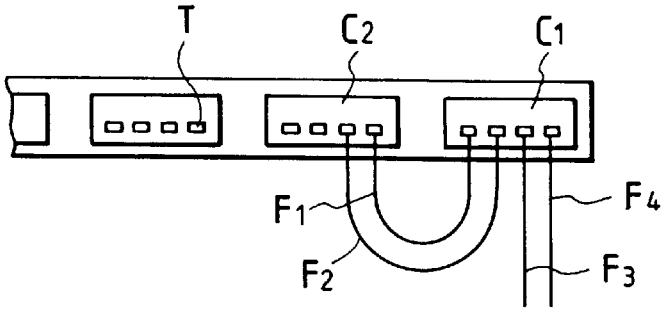
Figure 8C:
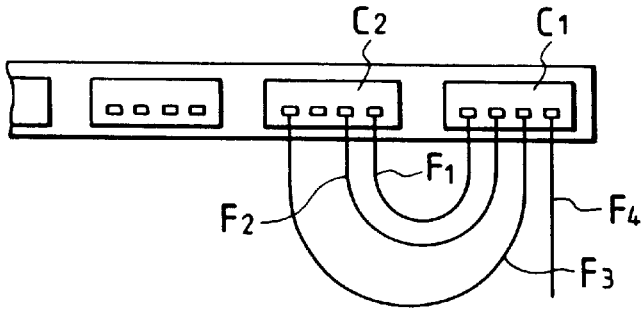
Figure 8D:
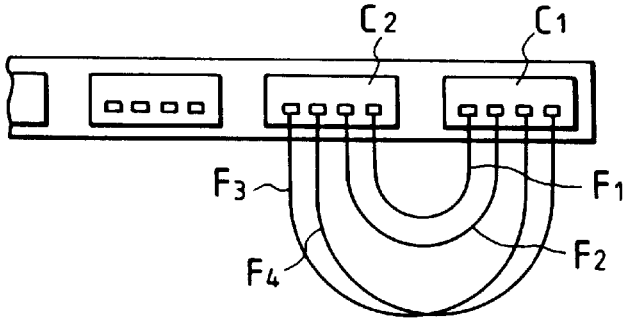
Figure 8E:
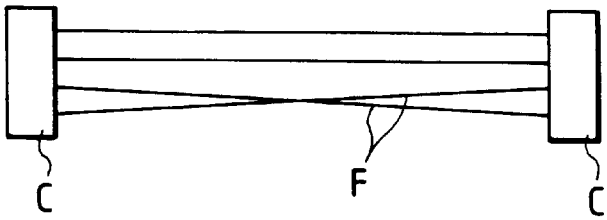
Figure 12:
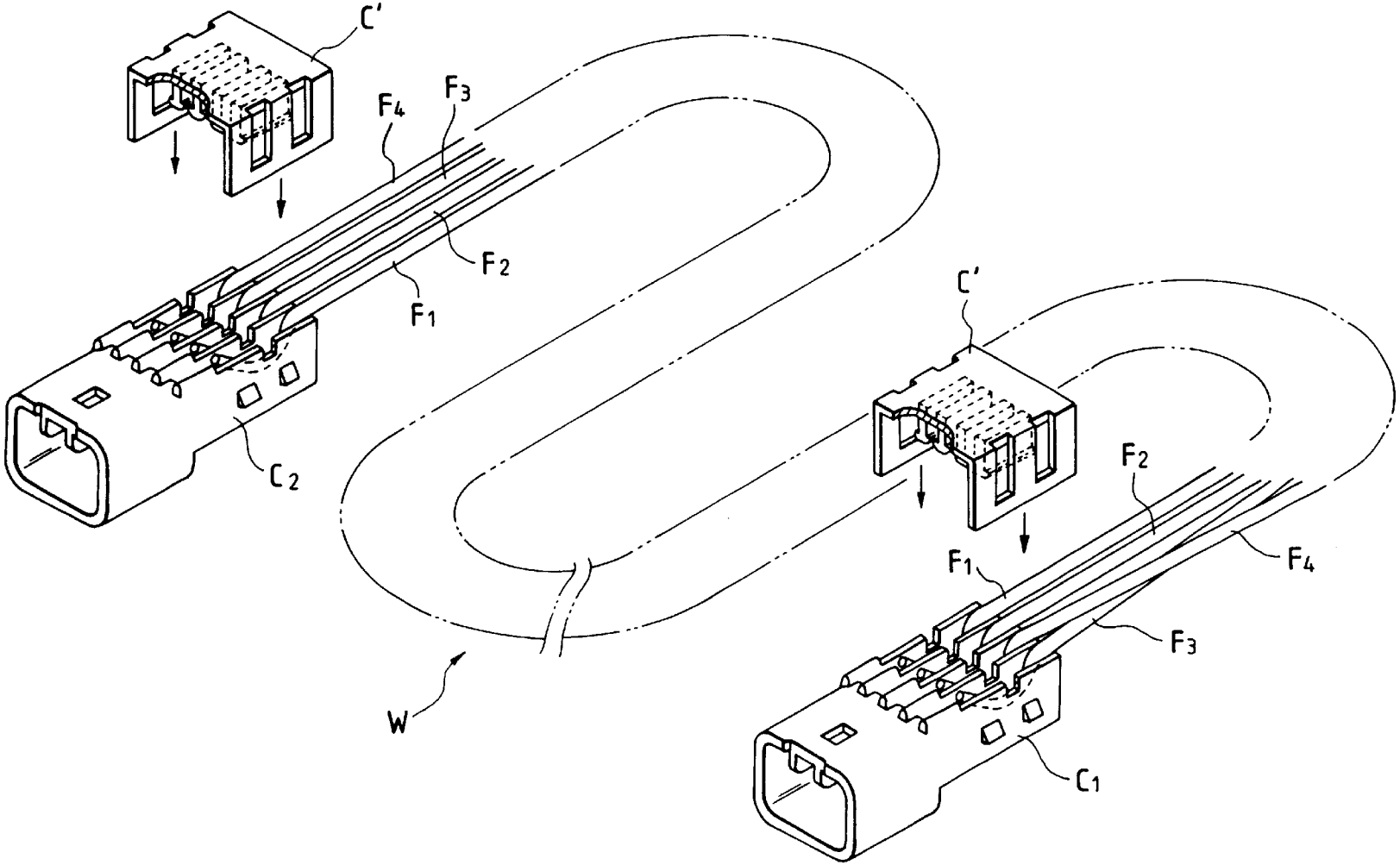
FIG. 12 is a perspective view showing an example of the wire harness.

The arrangement and action of the pressure-connecting section, the electrical wire feed section and the selecting mechanism of the pressure-blade of this embodiment are described above. Next, a process of manufacturing a wire harness of cross-wiring shown in FIGS. 8E and 12 will be explained below. In this manufacturing process, the pressure-connecting and wiring machine 70 is moved by the moving mechanism shown in FIG. 1.

In this case, in the objective wire harness W of cross wiring, the connector $C_1$ having four pressure-terminals $T_{11}$, $T_{12}$, $T_{13}$ and $T_{14}$ is connected to the connector $C_2$ having four pressure-terminals $T_{21}$, $T_{22}$, $T_{23}$ and $T_{24}$ by the electrical wires $F_1$, $F_2$, $F_3$ and $F_4$.

Since the number of the pressure-terminals is four, the number of the pressure-blades 2 of the set A to be used is also four, and the number of the pressure-blades 52 of the set B to be used is also four. In the following explanations, the pressure-blades 2 of the set A are represented by reference numerals $2_1$, $2_2$, $2_3$ and $2_4$, and the pressure-blades 52 of the set B are represented by reference numerals $52_1$, $52_2$, $52_3$ and $52_4$.

Figure 10B:
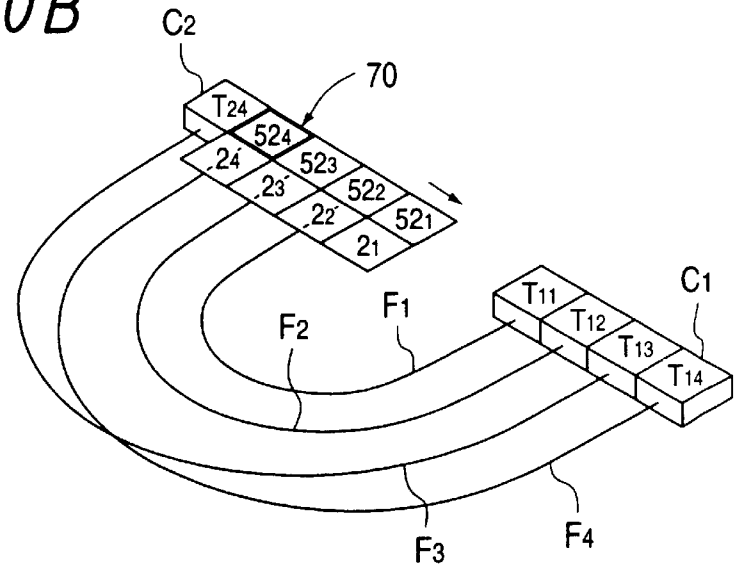
FIGS. 10A to 10C are views showing a model of the pressure-connecting process of the embodiment.
Figure 10A:
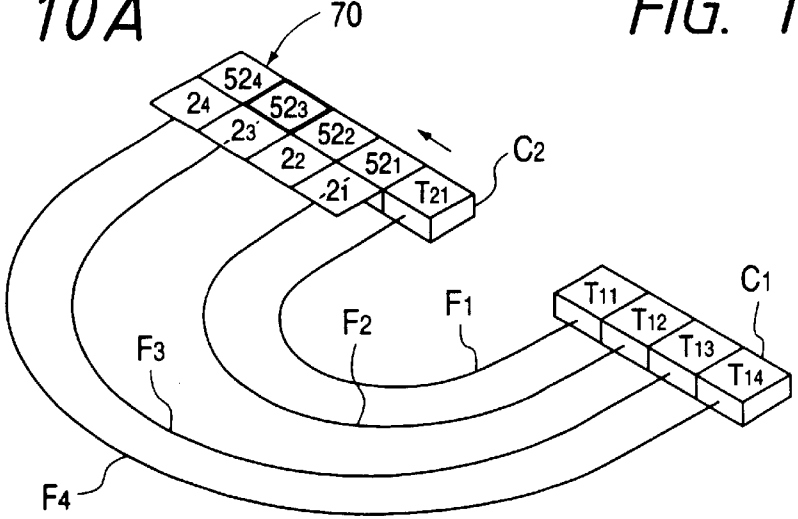
Figure 10C:
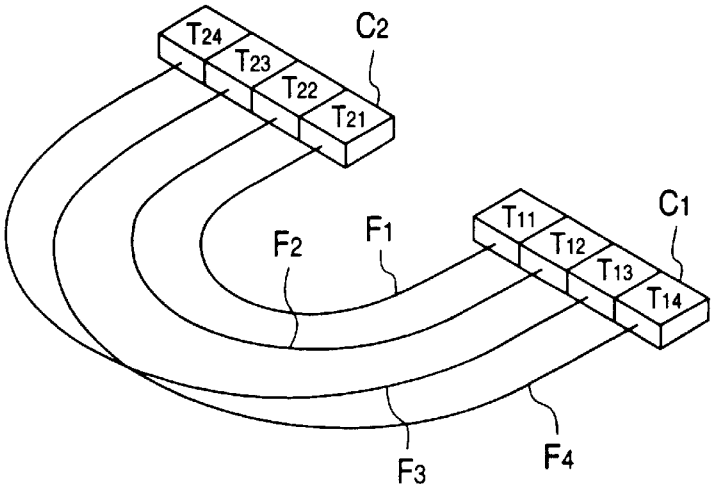
Figure 11C:
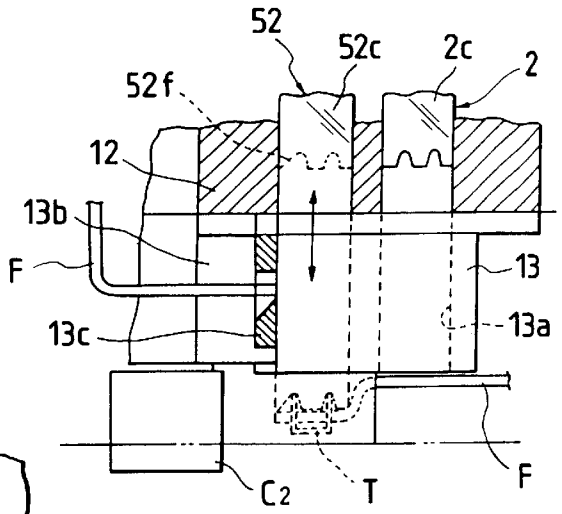
FIGS. 11A to 11C are views showing the detail of the primary portion of the pressure-connecting section of the connector of the embodiment.
Figure 11B:
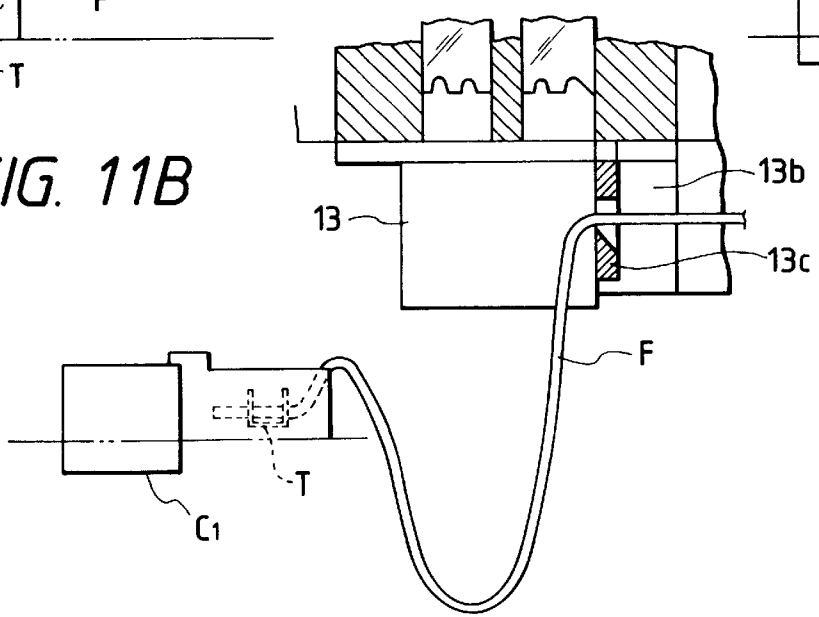
Figure 11A:
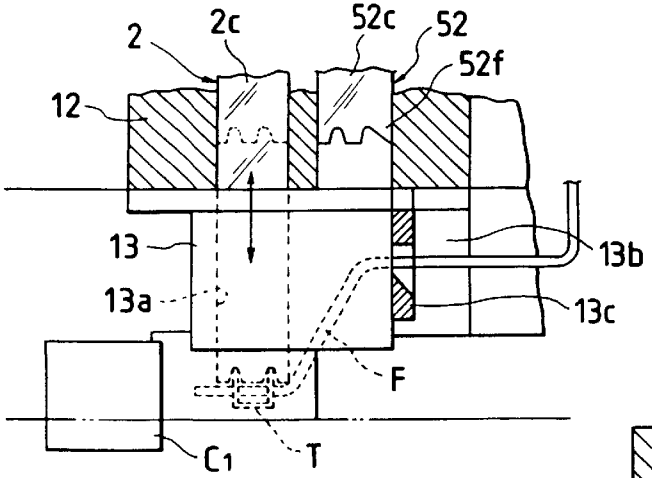

FIGS. 11A to 11C are views showing a primary portion in detail where pressure-connection is conducted. In FIGS. 9A to 10C, in order to clearly show a positional relations between the pressure-blades $2_1$, $2_2$, $2_3$, $2_4$, $52_1$, $52_2$, $52_3$ and $52_4$ and the pressure terminals $T_{11}$, $T1_2$, $T_{13}$, $T_{14}$, $T_{21}$, $T_{22}$, $T_{23}$ and $T_{24}$, the pressure-blades $2_1$, $2_2$, $2_3$, $2_4$, $52_1$, $52_2$, $52_3$ and $52_4$ of the pressure-connecting and wiring machine 70 are located in cubes and illustrated schematically.

In this embodiment, the wire harness is manufactured as follows. The electrical wires F are previously fed to the pressure-connecting section from the electrical wire feed section 40. Under the condition that the pushing piece 44*c* of the link 44 pushes each electrical wire F, all pressure-blades 52 on the side, on which the cutting blades 52*f* are formed, are selected by the selecting mechanism 50, and the elevating block 3 is lowered to cut the electrical wires F. In this way, the end portions of the electrical wires F are put in order. The connectors $C_1$ and $C_2$, the respective number of which is six, are set at predetermined positions by the pallets 72.

In the above state, the pressure-connecting and wiring machine 70 is moved to a position at which the pressure-blades 2 of the set A face the pressure-terminals T of one $C_1$ of the connectors. While the pressure-connecting and wiring machine 70 is being moved, or immediately after the pressure-connecting and wiring machine 70 has been moved, all pressure-blades 2 of the set A are selected by the selecting mechanism of the pressure-blades 2, 52. The selected pressure-blades $2_1$, $2_2$, $2_3$ and $2_4$ are surrounded by the bold black frames in FIG. 9A.

To the respective pressure-terminals $T_{11}$, $T_{12}$, $T_{13}$ and $T_{14}$, the electrical wire $F_1$, $F_2$, $F_3$ and $F_4$ are fed from the electrical wire feed section 40. As shown in FIG. 9A, end portions of these electrical wires are connected with pressure all at once by all pressure-blades $2_1$, $2_2$, $2_3$ and $2_4$ of the selected set A (shown in FIG. 9A). After the completion of pressure-connection, the cover is attached. The detail of the pressure-connecting section in the pressure-connection is shown in FIG. 11A. As shown in the drawing, even when the elevating block 3 is lowered, the pressure-blade 52 having the cutting blade 52*f* remains at an upper position, and only the pressure-blade having no cutting blade 52*f* connects the electric wire F to the pressure-terminal T of the connector $C_1$ with pressure.

Figure 9B:
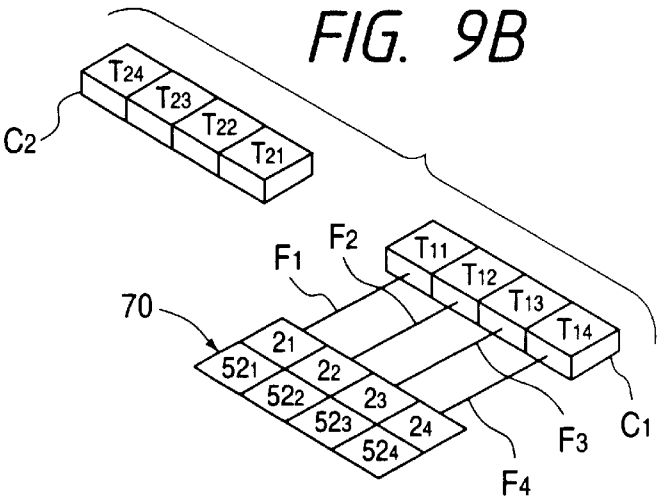
FIGS. 9A to 9D are views showing a model of the pressure-connecting process of the embodiment.
Figure 9C:
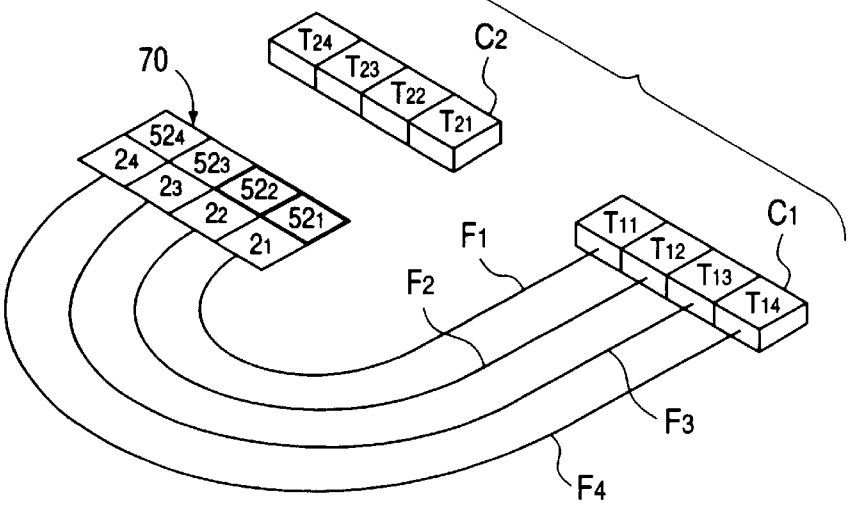

After the completion of the pressure-connection, as shown in FIG. 11B, the pressure-connecting and wiring machine 70 is raised from the connector $C_1$ and retracted onto the front side (FIG. 9B). Then, the electrical wire F of a predetermined length is drawn out from the electrical wire feed section 40, and the length is adjusted. After that, the electrical wire F of the predetermined length is accumulated. After the adjustment of the length of the electrical wire, or simultaneously with the adjustment of the length of the electrical wire, the pressure-connecting and wiring machine 70 is turned by an angle of 180°, so that the direction of the pressure-connecting and wiring machine 70 with respect to the connectors $C_1$ and $C_2$ is reversed. In the above state, the pressure-connecting and wiring machine 70 is moved to a position at which it faces the pressure-terminal T of the connector $C_2$ (FIG. 9C).

After the pressure-connecting and wiring machine 70 has been moved, or alternatively while the pressure-connecting and wiring machine 70 is being moved, the selecting mechanism is operated, and only the blades $52_1$ and $52_2$ are selected from the pressure-blades 52. In this case, the selected pressure-blades $52_1$ and $52_2$ are surrounded by a bold black frame in FIG. 9C. Under the condition that all pressure-blades 2 of the set A and the residual blades $52_3$ and $52_4$ of the pressure-blades 52 of the set B are retracted, they are fixed. In order to fix the pressure-blades, the selectiing bars 31 of the cylinder 30 are inserted into the insertion holes 2*d*, 52*d* of the L-shaped vertical sections of the pressure blades.

Figure 9D:
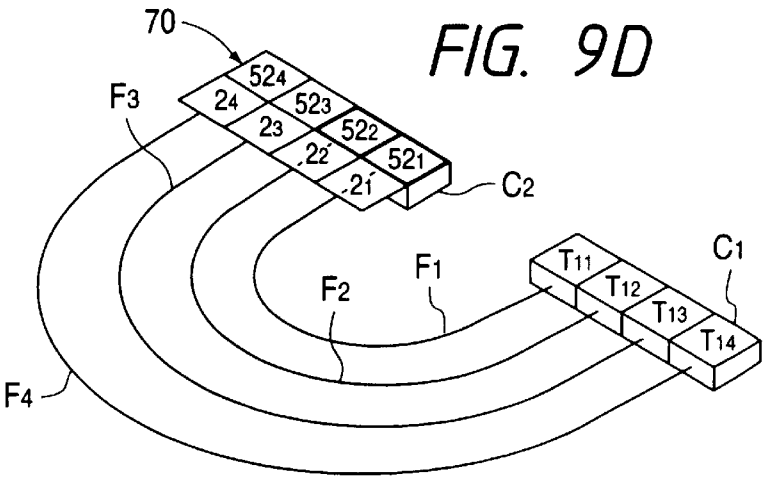
Figure 9A:
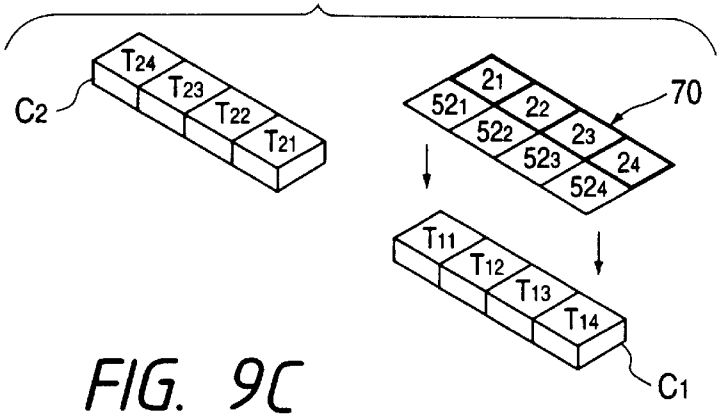

Successively, as shown in FIG. 9D, the pressure-connecting and wiring machine 70 is lowered, and the electrical is wires $F_1$ and $F_2$ are inserted into and connected to the grooves of the pressure-terminals $T_{21}$ and $T_{22}$ of the connector $C_2$ with pressure. At the same time, the electrical wires $F_1$ and $F_2$ are cut by the cutting blade 52*f* attached to the pressure-blades $\mathbf{52}_1$ and $\mathbf{52}_2$. The detail of the pressure-connecting section in the pressure-connection is shown in FIG. 11C. As shown in the drawing, even when the elevating block 3 is lowered, the pressure-blade 2 having no cutting blades 52*f* remains at an upper position, and only the pressure-blades $\mathbf{52}_1$ and $\mathbf{52}_2$ having the cutting blades 52*f* connect the electric wires $F_1$ and $F_2$ to the pressure-terminals $T_{21}$ and $T_{22}$ of the connector $C_2$ with pressure.

Next, the pressure-connecting and wiring machine 70 is raised and separated from the pressure-terminal T of the connector $C_2$. While the pressure-connecting and wiring machine 70 is being raised, or immediately after the pressure-connecting and wiring machine 70 has been raised, the selecting mechanism 50 is operated, so that only the pressure-blades $\mathbf{52}_3$ is selected from the pressure-blades 52 in the set B. Under the condition that all pressure-blades 2 of the set A and the residual blades $\mathbf{52}_1$, $\mathbf{52}_2$, $\mathbf{52}_4$ of the pressure-blades 52 of the am set B are retracted upward, they are fixed. Then, the pressure-connecting and wiring machine 70 is moved in the direction of the arrangement of the pressure-terminals T (the direction of the arrow in the drawing) so that the pressure-blade $\mathbf{52}_3$ can be located in the groove of the pressure-terminal $T_{24}$ of the connector $C_2$ as shown in FIG. 10A.

Successively, the pressure-connecting and wiring machine 70 is lowered, and the electrical wire $F_3$ is inserted into and connected to the groove of the pressure terminal $T_{24}$ with pressure. At the same time, the electrical wire $F_3$ is cut by the cutting blades 52*f* attached to the pressure-blade $\mathbf{52}_3$. The detail of the pressure-connecting acting section at this time is the same as that shown in FIG. 11C.

In the same manner as described above, when the pressure-terminal $T_{14}$ is connected to the pressure-terminal $T_{23}$ by the electrical wire $F_4$, the pressure-blade $\mathbf{52}_4$ is selected from the pressure-blades 52 of the set B, and the pressure-connecting and wiring machine 70 is moved horizontally in the direction of the arrangement of the pressure-terminals $T_2$ (the direction of the arrow shown in FIG. 10B). When the pressure-blade $\mathbf{52}_4$ comes to a position immediately above the terminal $T_{21}$, the elevating block is lowered, so that the pressure-connection can be accomplished. After the pressure-connecting and wiring machine 70 has been retracted, the wire harness W of cross wiring shown in FIG. 10C can be obtained.

After that, the pallets 72 are moved, or the pressure-connecting and wiring machine 70 is manually moved to the left, and the above actions are performed. In this way, it is possible to obtain the wire-harness W shown in FIG. 12 continuously. The cover C' is attached to the connector C by an appropriate means.

As described above, in the pressure-connecting apparatus of this embodiment, the desired pressure-blades 2, 52 are selected from the plurality of pressure-blades 2, 52 by the selecting mechanism, and pressure-connection is conducted only by the selected pressure-blades 2, 52. Therefore, when the wire harness of cross-wiring is manufactured, the wiring motions can be remarkably omitted as follows. First, the electrical wires F are connected to one connector $C_1$ with pressure all at once. Then, when the wiring motion (horizontal movement), in which the pressure-connecting and wiring machine 70 is moved to the other connector C2, is conducted only once, the pressure-connection of the connector $C_2$ can be accomplished only by moving the pressure-connecting and wiring machine 70 in the direction of the arrangement of the pressure-terminals of the connector $C_2$. Compared with the conventional case in which the pressure-connecting and wiring machine 70 is returned to the side of one connector $C_1$ each time, the wiring motions can be remarkably omitted.

Figure 15A:
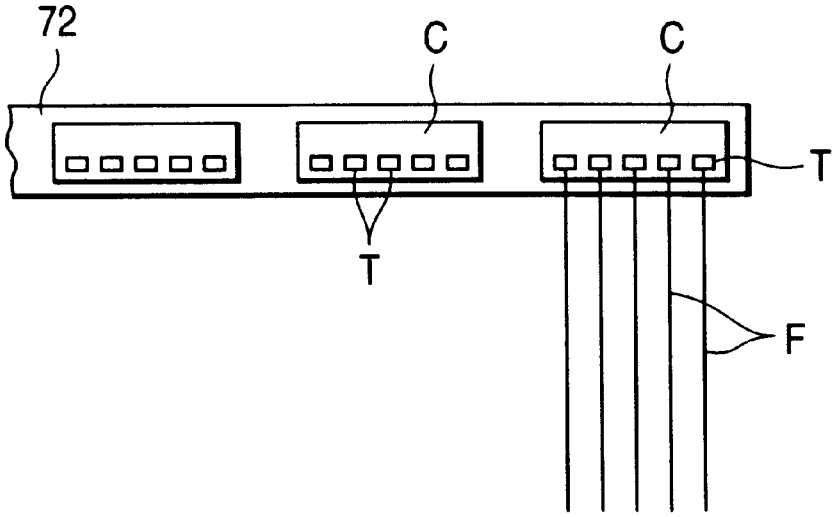
FIGS. 15A and 15B are schematic illustrations to explain another pressure-connection and wiring of the embodiment.
Figure 15B:
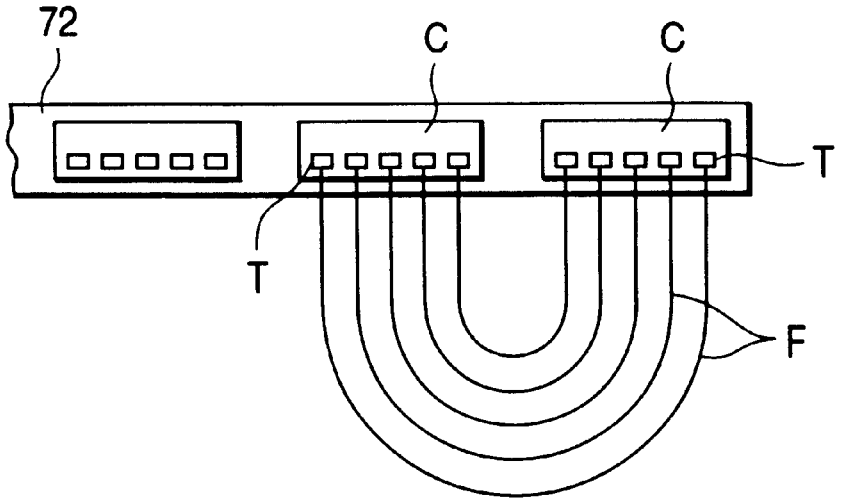
Figure 16:
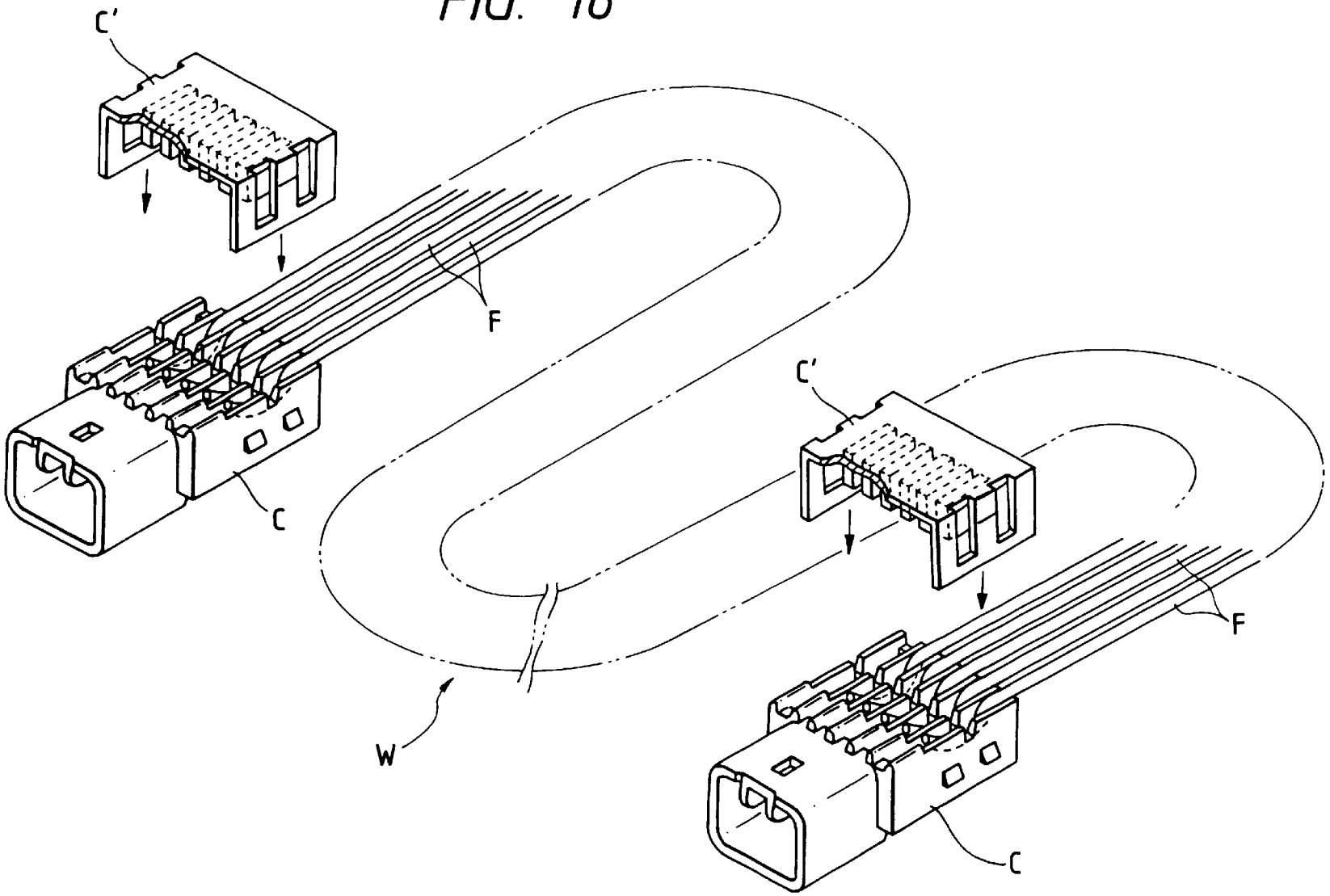
FIG. 16 is a perspective view of another example of the wire harness.

In this embodiment, the wire harness of cross wiring is manufactured. In the manufacture of the wire harness W shown in FIGS. 15 and 16, all wires F of which are arranged in parallel with each other, the manufacture is completed when the pressure-connection is conducted by two motions shown in FIGS. 15A and 15B. In the case of pressure-connection in which all electrical wires are connected all at once, it is not necessary that the pressure-blades 2, 52 are moved individually. Accordingly, it is possible to use the pressure-connecting and wiring machine 70 in which the pressure-blades 2, 52 are integrated into one body.

Figure 17:
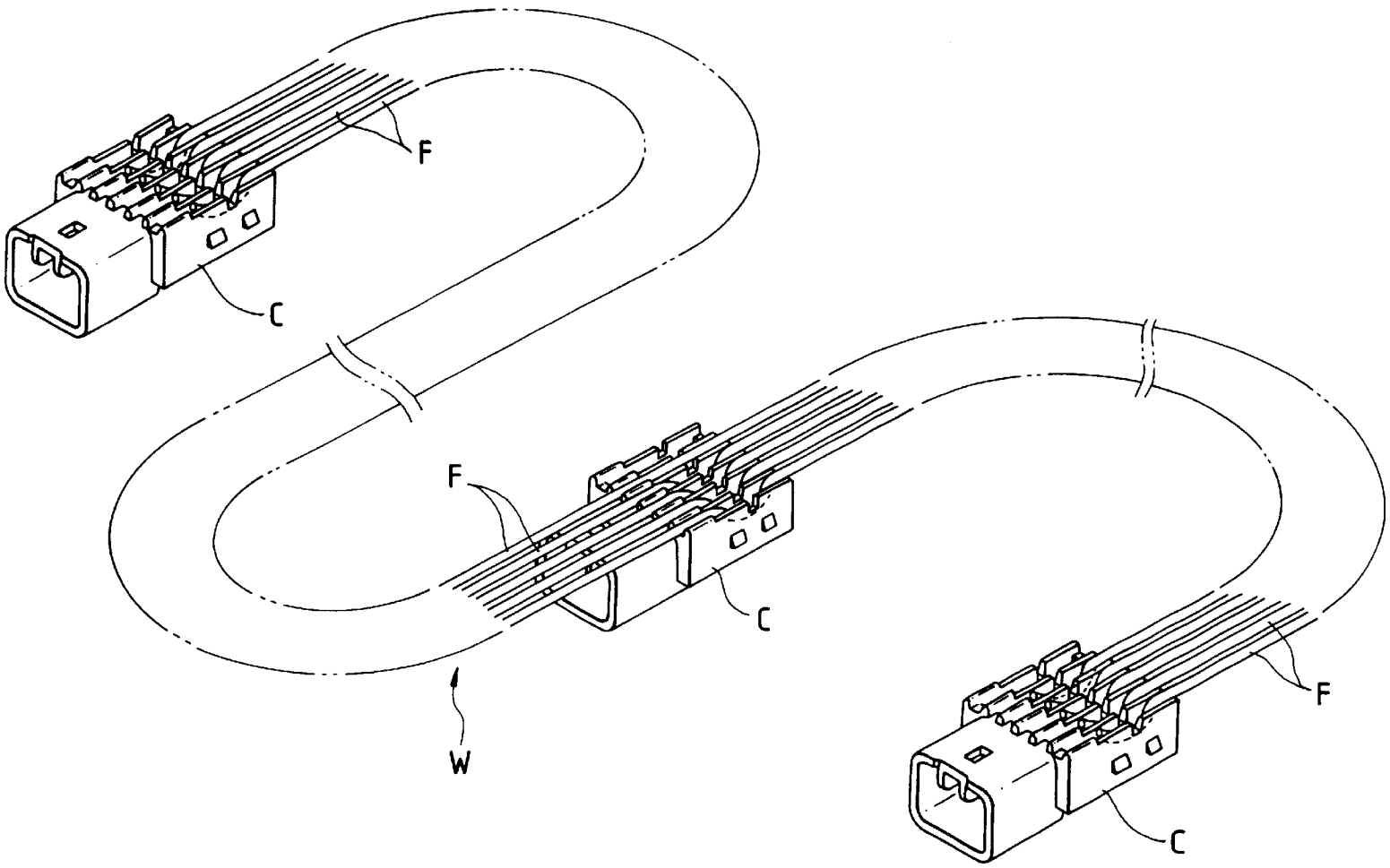
FIG. 17 is a perspective view of another example of the wire harness.
Figure 18:
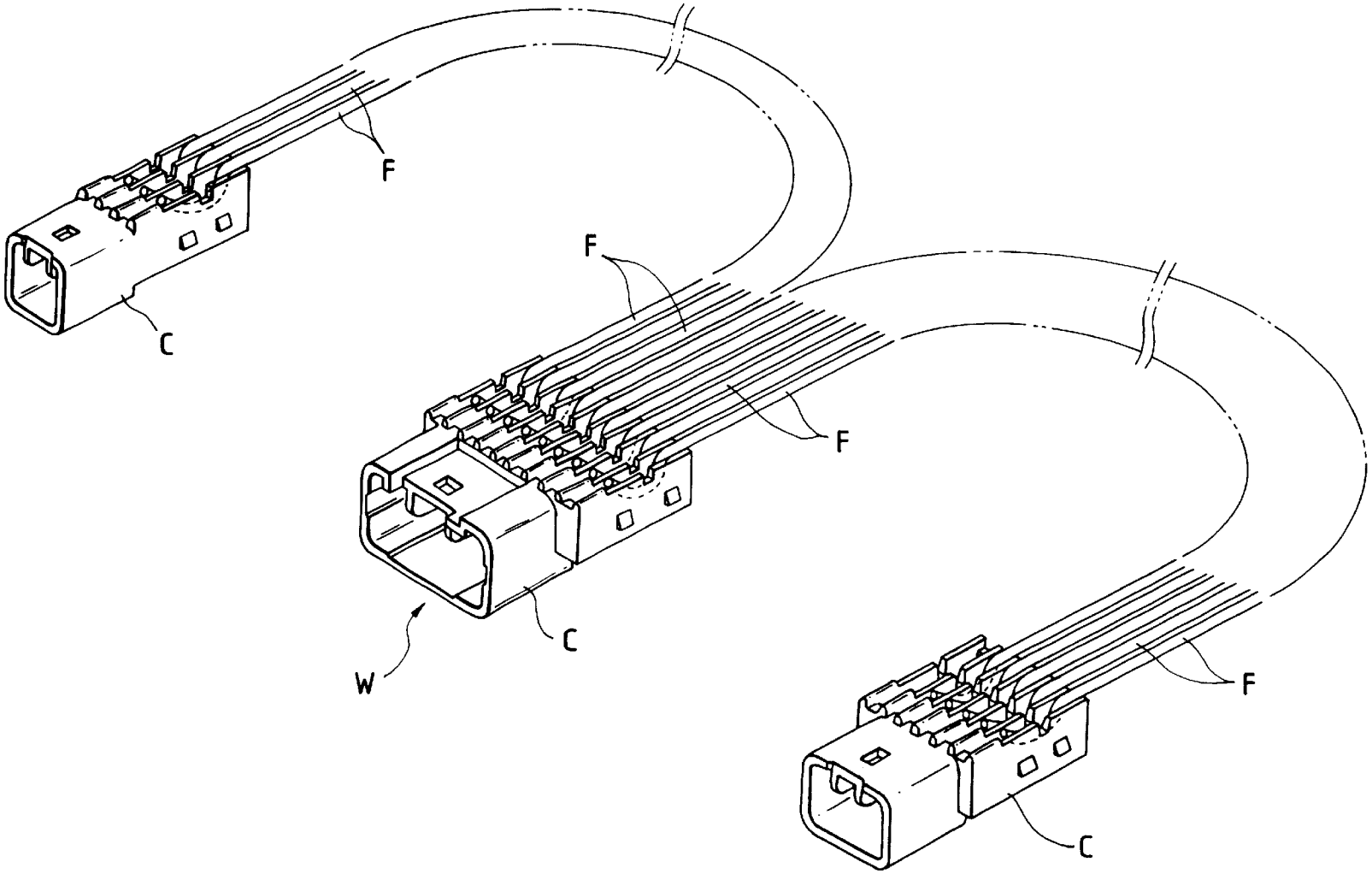
FIG. 18 is a perspective view of another example of the wire harness.
Figure 19:
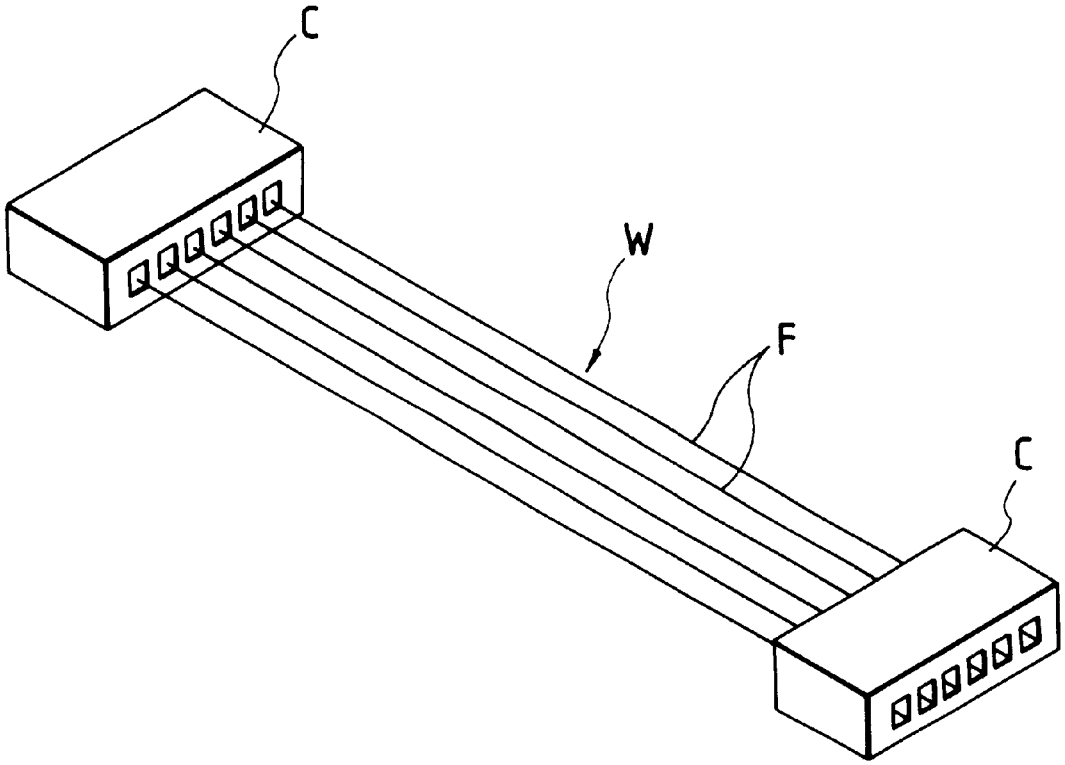
FIG. 19 is a perspective view of another example of the wire harness.
Figure 20:
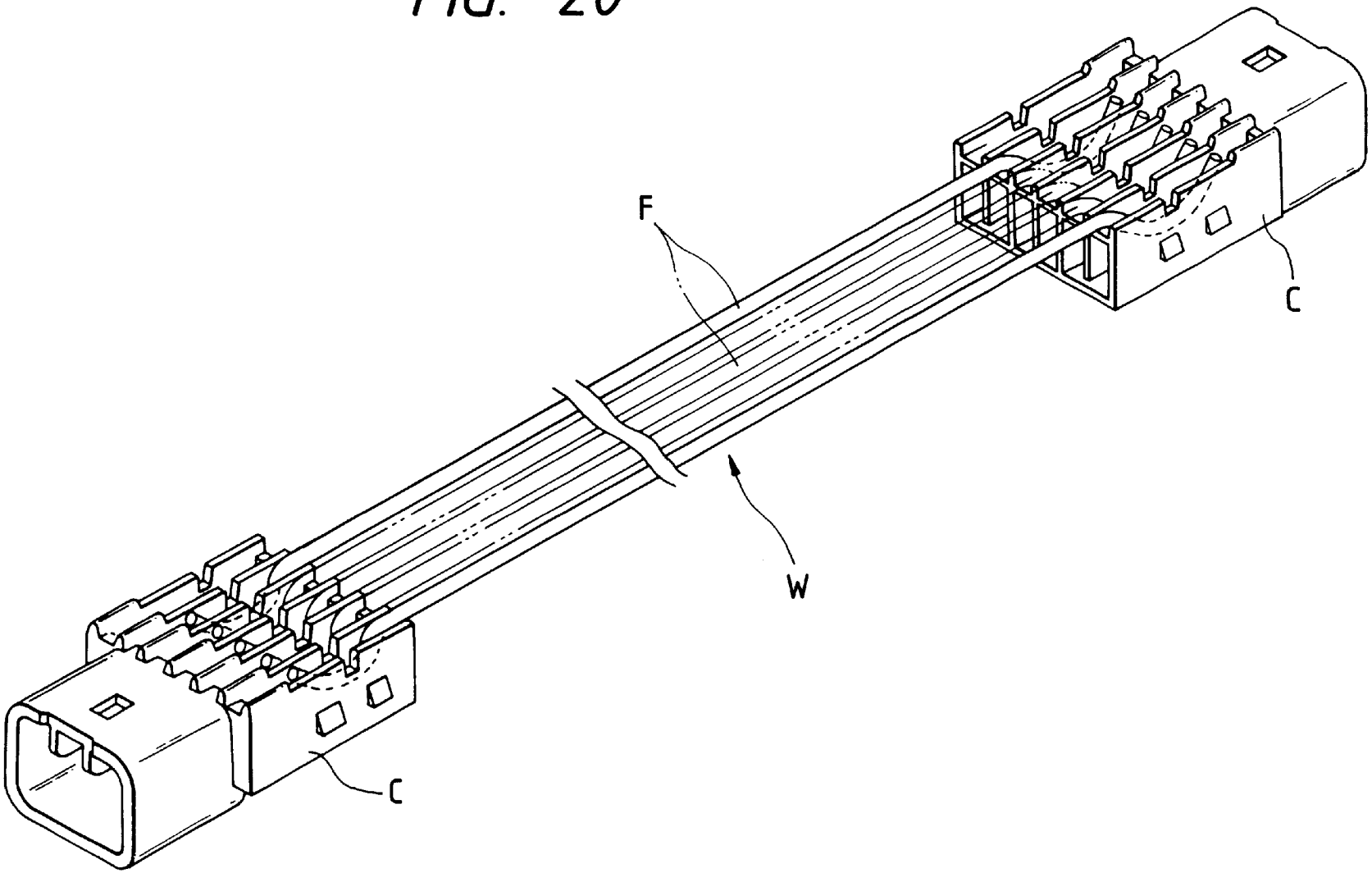
FIG. 20 is a perspective view showing an outline of another example of the wire harness.

In the case of the wire harness W shown in FIG. 17 in which the connector C is interposed in the middle, and also in the case of the wire harness W shown in FIG. 18 in which the numbers of the pressure-terminals of the connectors C are different from each other, of course, when the pressure-blades 2, 52 are selected appropriately and also when the pressure-connecting and wiring machine 70 is operated appropriately, it is possible to obtain a desired wire harness.

Since the present invention is composed as explained above, it is easy to ensure a space for accumulating the parallel electrical wires. Therefore, it is possible to reduce the size of the apparatus.

The foregoing description of the preferred embodiments of the invention has been presented for the purpose of illustration and description only. It is not intended to be exhaustive or to limit the invention to the precise form disclosed, and modifications and variations are possible in light of and within the scope of the invention. The preferred embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and equivalents thereof.

What is claimed is:

1. A method of manufacturing a wire harness in which both ends of a plurality of electric wires are respectively connected to pressure-terminals attached to connectors with pressure by a pressure-connecting and wiring machine comprising the steps of:

feeding the connectors one after another to an electric wire pressure-connecting section of the pressure-connecting and wiring machine in a parallel direction of the arrangement of pressure-terminals;

first connecting one ends of the electric wires to the pressure-terminals in one of the connectors with pressure;

drawing out the pressure-connected electric wires from the pressure-connecting and wiring machine by a predetermined length;

turning the pressure-connecting and wiring machine round an axis of a vertical direction thereof in a range of a predetermined angle.

second connecting the other ends of the drawn-out electric wires to the pressure-terminals in the other connector with pressure.

2. A method of manufacturing a wire harness according to claim 1, wherein said drawing out step is conducted by said turning step at the same time.

3. A method of manufacturing a wire harness according to claim 1, wherein said turning step is turned round the axis of the vertical direction in the range of 180°.

4. A method of manufacturing a wire harness according to claim 1, further comprising the step of:

cutting the electric wires simultaneous with at least one of the connecting steps.

5. A method of manufacturing a wire harness according to claim 1, further comprising the step of:

moving at least one of the pressure-connecting and wiring machine and the connector in the parallel direction during the second connecting step, whereby the plurality of electric wires are laid to cross over each other.

6. A method of manufacturing a wire harness in which both ends of a plurality of electric wires are respectively connected to pressure-terminals attached to connectors with pressure by a pressure-connecting and wiring machine, comprising the steps of:

feeding the connectors into an electric wire pressure-connecting section of the pressure-connecting and wiring machine from a predetermined direction;

first connecting one end of the electric wires to the pressure-terminals in one of the connectors with pressure;

drawing out the pressure-connected electric wires from the pressure-connecting and wiring machine in a direction perpendicular to the predetermined direction;

turning the pressure-connecting and wiring machine around an axis of a vertical direction in the hinge of 180°; and second connecting the other end of the electric wires to the pressure-terminals in the other connectors with pressure.

7. A method of manufacturing a wire harness in which both ends of at least first and second electric wires are respectively connected to pressure-terminals attached to connectors with pressure by a pressure-connecting and wiring machine, comprising the steps of:

feeding the connectors into an electric wire pressure-connecting section of the pressure-connecting and wiring machine from a predetermined direction;

first connecting one end of the first and second electric wires to the pressure-terminals in one of the connectors with pressure;

drawing out the pressure-connected first and second electric wires from the pressure-connecting and wiring machine in a direction perpendicular to the predetermined direction;

turning the pressure-connecting and wiring machine around an axis of a vertical direction in the range of 180°;

second connecting the other end of said first electric wire to the pressure-terminal in the other connectors with pressure;

moving at least one of the pressure-connecting and wiring machine and the connectors in the predetermined direction; and third connecting the other end of the second electric wire to the pressure-terminal in the other connectors with pressure.

8. A method according to claims 7, wherein the other connectors includes a first and a second connector, the other end of the first electric wire is connected to the pressure-terminal in the first connector with pressure, and the other end of the second electric wire is connected to the pressure-terminal in the second connector with pressure.

* * * * *